US005924340A

United States Patent [19]

Junkers

[11] Patent Number: 5,924,340

[45] Date of Patent: Jul. 20, 1999

[54] FLUID-OPERATED TOOL

[76] Inventor: John K. Junkers, 7 Arrowhead La., Saddle River, N.J. 07540

[21] Appl. No.: 09/067,696

[22] Filed: Apr. 28, 1998

[51] Int. Cl.[6] ..... B25B 13/46

[52] U.S. Cl. ..... 81/57.39; 81/57.44

[58] Field of Search ..... 81/57.39, 57.44

[56] References Cited

U.S. PATENT DOCUMENTS 5,203,238 4/1993 Ferguson ..... 81/57.39

5,515,753 5/1996 Wagner et al. ..... 81/57.39

*Primary Examiner*—Timothy V. Eley

*Assistant Examiner*—Sinclair Skinner

*Attorney, Agent, or Firm*—Michael J. Striker

[57] ABSTRACT

A fluid-operated tool for tightening and loosening of threaded connectors has a turnable engaging unit for engaging a threaded connector so as to turn the threaded connector and to tighten and loosen the threaded connector; and driving unit connected with the engaging unit and acting on the engaging unit so as to turn the engaging unit, the driving unit including two fluid-operated driving elements connected to the engaging unit and operated so that during an initial stage of tightening or a final stage of loosening of a threaded connector one of the fluid-operated driving elements is actuated and drives the engaging unit, while during a final stage of tightening or an initial stage of loosening of a threaded connector the other of the fluid-operated driving elements is operated.

9 Claims, 3 Drawing Sheets

61
34
42
31
32
42
33
41
36
39
37
38

FLUID-OPERATED TOOL

BACKGROUND OF THE INVENTION

The present invention relates to fluid-operated tools, such as for example hydraulic wrenches and the like.

Fluid-operated tools of this type are known in the art. In a known fluid-operated tool an engaging means engage a threaded connector to be tightened or loosened and turn the threaded connector correspondingly, while a driving means is connected with the engaging means so as to apply the driving force and to turn the engaging means correspondingly. In the known fluid-operated means, the driving means usually include a fluid-operated cylinder-piston unit. It is well known that during tightening of a threaded connector it is first of all necessary to turn the threaded connector or to run it down into an object over a long stroke, and then at a final stage to apply a greater torque over a short stroke to provide the tightening itself. During loosening of the threaded connector the situation is reversed, in particular it is first necessary to apply a substantial torque to loosen a threaded connector and then to run the threaded connector off the object over a long stroke. In the known fluid-operated tool the tightening and loosening of the threaded connector performed with the same fluid-operated driving means is carried out with the same speed through both stages of the process. However, as explained hereinabove, the first stage of the tightening does not require a great torque but instead requires a longer run connected with a longer time, while the further stage of the tightening requires a greater torque and a shorter run. Usually, the tools are designed so as to provide the slow and high-torque tightening, and therefore the stages of running-down and running-off are very slow and take a long time.

SUMMARY OF THE INVENTION

Accordingly, it is an object of the present invention to provide a fluid-operated tool which avoids the disadvantages of the prior art.

In keeping with these objects and with others which will become apparent hereinafter, one feature of present invention resides, briefly stated, in a fluid-operated tool for tightening and loosening of threaded connectors, which comprises turnable engaging means for engaging a threaded connector so as to turn the threaded connector and to tighten and loosen the threaded connector, and driving means connected with the engaging means and acting on the engaging means so as to turn the engaging means, the driving means including two fluid-operated driving elements connected to the engaging means and operated so that during an initial stage of tightening or a final stage of loosening of a threaded connector one of the fluid-operated driving elements is actuated and drives the engaging means, while during a final stage of tightening or an initial stage of loosening of a threaded connector the other of the fluid-operated driving elements is operated.

When the fluid-operated tool is designed in accordance with the present invention, then during the initial stage of tightening of a threaded connector (running-down) one of the fluid-operated driving elements is actuated so as to perform a faster stroke with a lower torque, while during a final stage of the tightening of the threaded connector the second fluid-operated driving element is also activated to provide a greater torque with a shorter stroke.

During loosening of a threaded connector, the situation is opposite and the operation of the fluid-operated tool is reversed. During the initial stage of the loosening of a threaded connector, the other fluid-operated driving element or both fluid-operated driving elements are activated to apply a greater torque over a shorter stroke, and then during the final stage of loosening the threaded connector (running-off), only one fluid-operated driving element is activated to provide a lower torque with a faster stroke.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
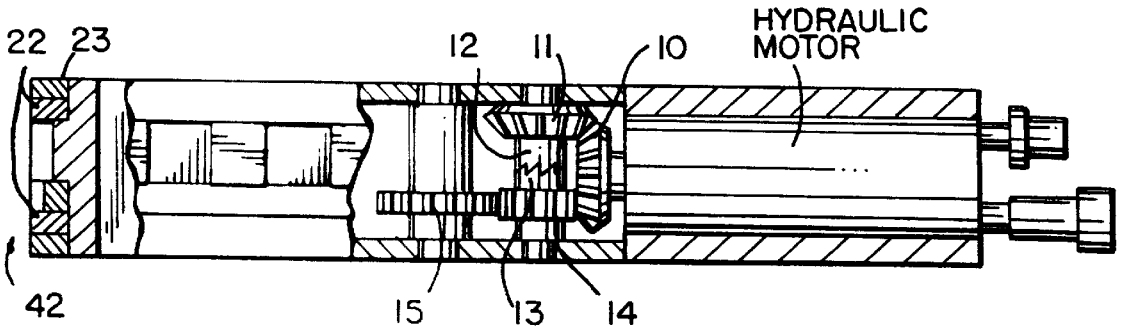
FIG. 1 is a plan view of a fluid-operated tool in accordance with one embodiment of the present invention.
Figure 2:
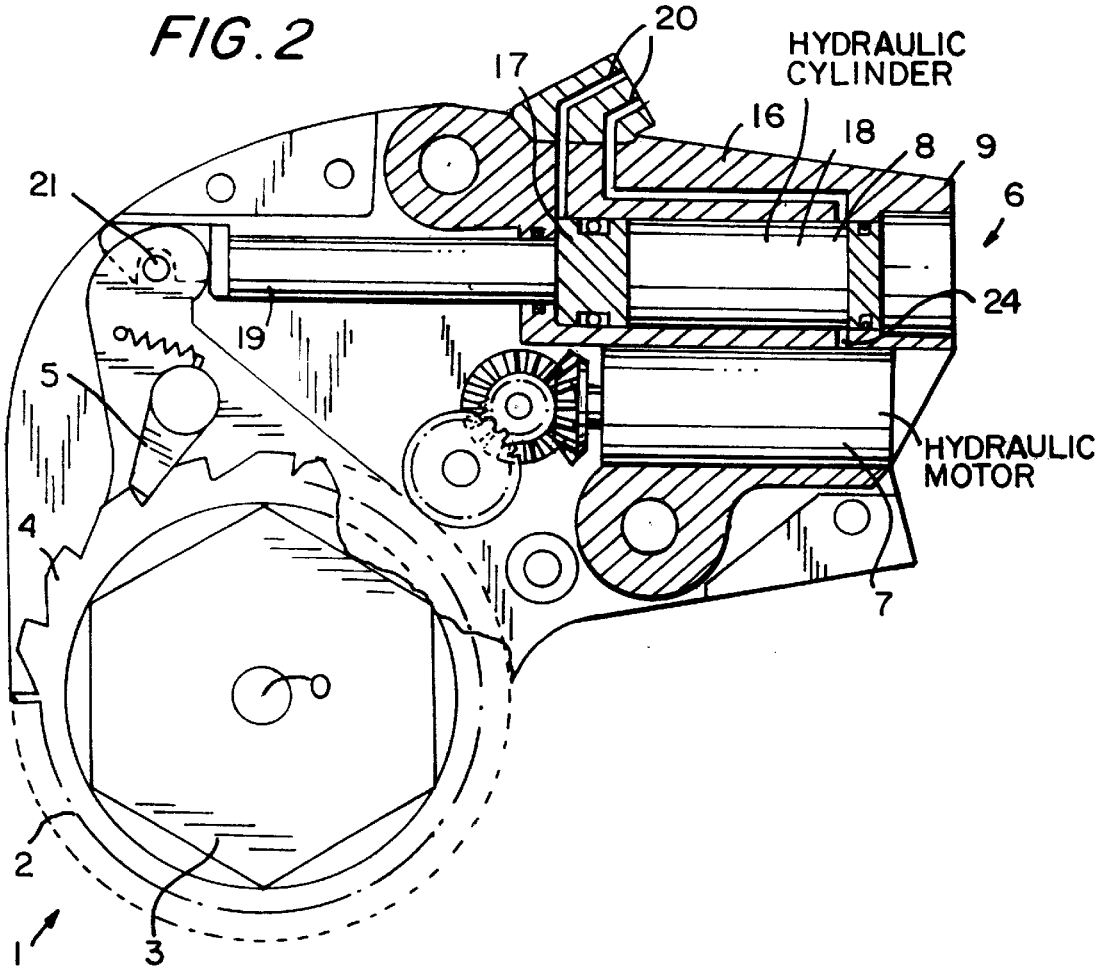
FIG. 2 is a cross-section of the side view of the fluid-operated tool of FIG. 1.

A fluid-operated tool in accordance with one embodiment of the present invention is shown in FIGS. 1 and 2. The fluid-operated tool has turnable engaging means for engaging and turning a threaded connector, such as a nut, a bolt, and the like. The engaging means is identified as a whole with reference numeral 1 and include a ratchet 2 provided with an inner opening which for example has a hexagonal shape to engage the nut, the bolt head, etc. The outer periphery of the ratchet 2 has a plurality of teeth 4, and a turnable pawl 5 engages with the teeth 4.

The fluid-operated tool further has driving means which is connected with the engaging means to turn the engaging means. The driving means is identified as a whole with reference numeral 6. The driving means 6 is formed as a fluid-operated driving means and include in accordance with the present invention two fluid-operated driving elements. One of the fluid-operated driving elements is formed as a hydraulic motor 7, while the other of the fluid-operated driving elements is formed as a cylinder-piston unit 8. Both fluid-operated driving elements 7, 8 are arranged in a housing 9 portion and adjacent to one another. The fluid-operated driving elements 7, 8 adjoin one another in the direction perpendicular to an axis of the driving means and in a plane extending perpendicular to the axis O of the engaging means.

The hydraulic motor 7 is connected with the ratchet 2 through a transmission. The transmission includes a bevel gear 10 connected with the shaft of the hydraulic motor, another bevel gear 11 engaging with the bevel gear 10, an overrunning coupling including a first coupling half 12 fixedly connected with the bevel gear 11 and a second coupling half 13 fixedly connected with a spur gear 14, and a spur gear 15 which engages with the spur gear 14 on the one hand and with the teeth 4 of the ratchet 2 on the other hand.

The cylinder-piston unit 8 has a cylinder 16 with a piston 17 reciprocating in an inner chamber 18 of the cylinder 16 and provided a with piston rod 19. A working fluid is supplied to and withdrawn from the cylinder 16 through passages 20. The opposite end of the piston rod 19 turnably engages a pin 21 connecting two drive plates 22 which carry the paws 5. Two side plates 23 are located at opposite sides of the drive plates 22 and form another portion of the housing. A valve 24 is provided between the chamber 18 of the cylinder-piston unit 8 and the hydraulic motor 7.

The fluid-operated tool in accordance with the present invention operates in the following manner.

When it is necessary to tighten a threaded connector, the working fluid is supplied to the driving means 6 and flows through the inner chamber 18 of the cylinder-piston unit 8 into the hydraulic motor 7 through the valve. During the initial stage of tightening a threaded connector, for example a nut, it is just ran down to reach a corresponding object, such as a flange or the like in which a bolt with the nut is screwed. During this initial stage there is a little resistance to tightening, and therefore the working fluid freely flows into the hydraulic motor through the cylinder piston unit 8, activates the hydraulic motor 7, so that through the transmission the ratchet 2 is turned with a high speed at a low torque. The valve 24 is formed so that it is open when there is a low resistance. When the threaded connector is ran down, and the tightening itself with a high torque is to be performed, a resistance of the threaded connector increases and as a result the valve 24 closes. The full power of the working fluid now acts in the cylinder-piston unit 8, the piston 17 reciprocates and its piston rod 19 turns the drive plates 22 with the pawls 5 so as to turn the ratchet 2 with a high torque which is necessary to portion the tightening of the threaded connector. The coupling 12, 13 is designed so that the teeth of the coupling house 12, 13 slip over one another during this stage. Thus, during the initial stage of tightening of the threaded connector, the ratchet 2 and therefore the threaded connector is turned with a high speed at a low torque by the hydraulic motor 7, while during the final stage of tightening of the threaded connector the ratchet 2 and thereby the threaded connector is turned with a high torque by the cylinder-piston unit 8.

Figure 3:
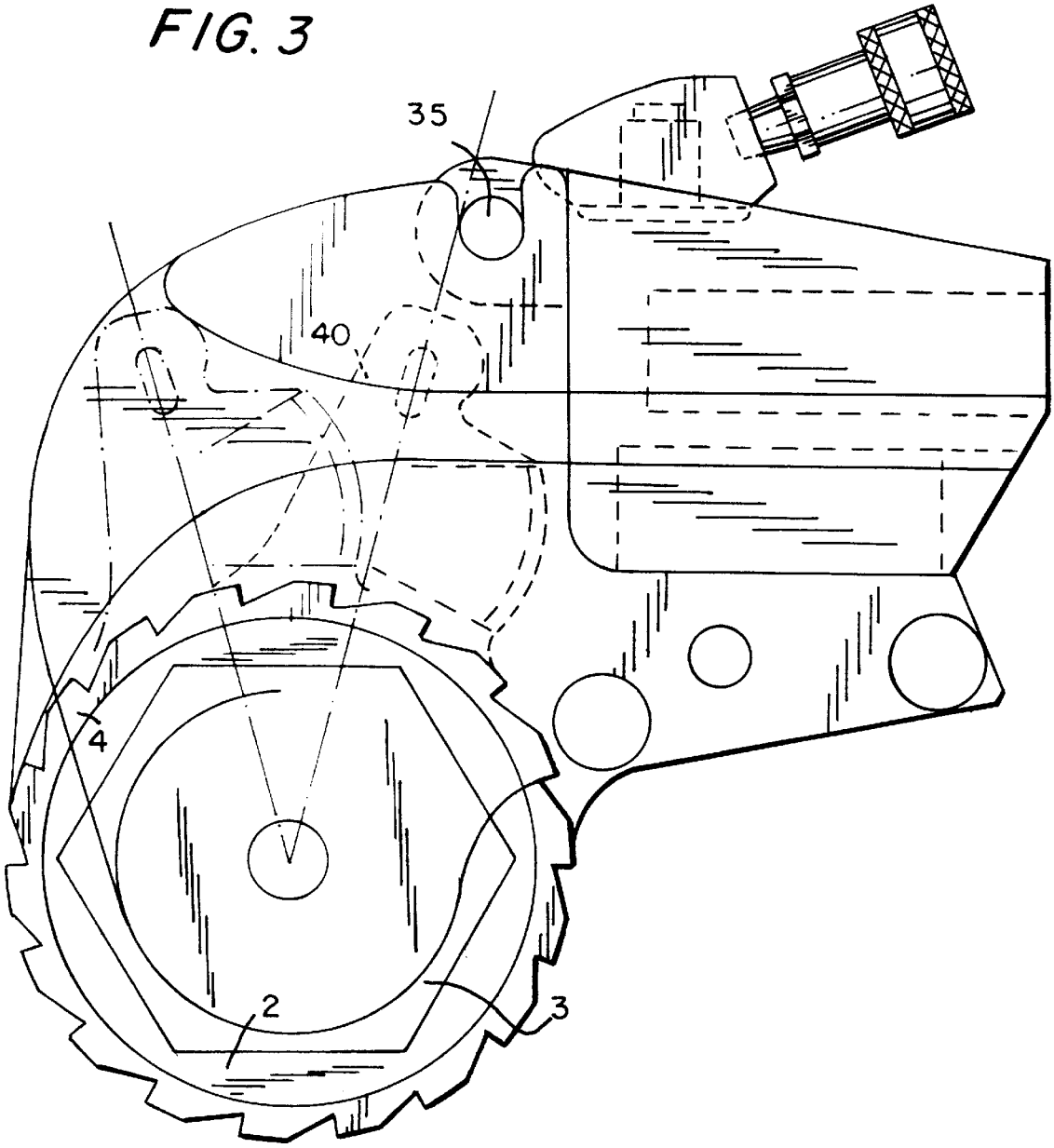
FIG. 3 is a side view of a fluid operated tool in accordance with another embodiment of the present invention.
Figure 4:
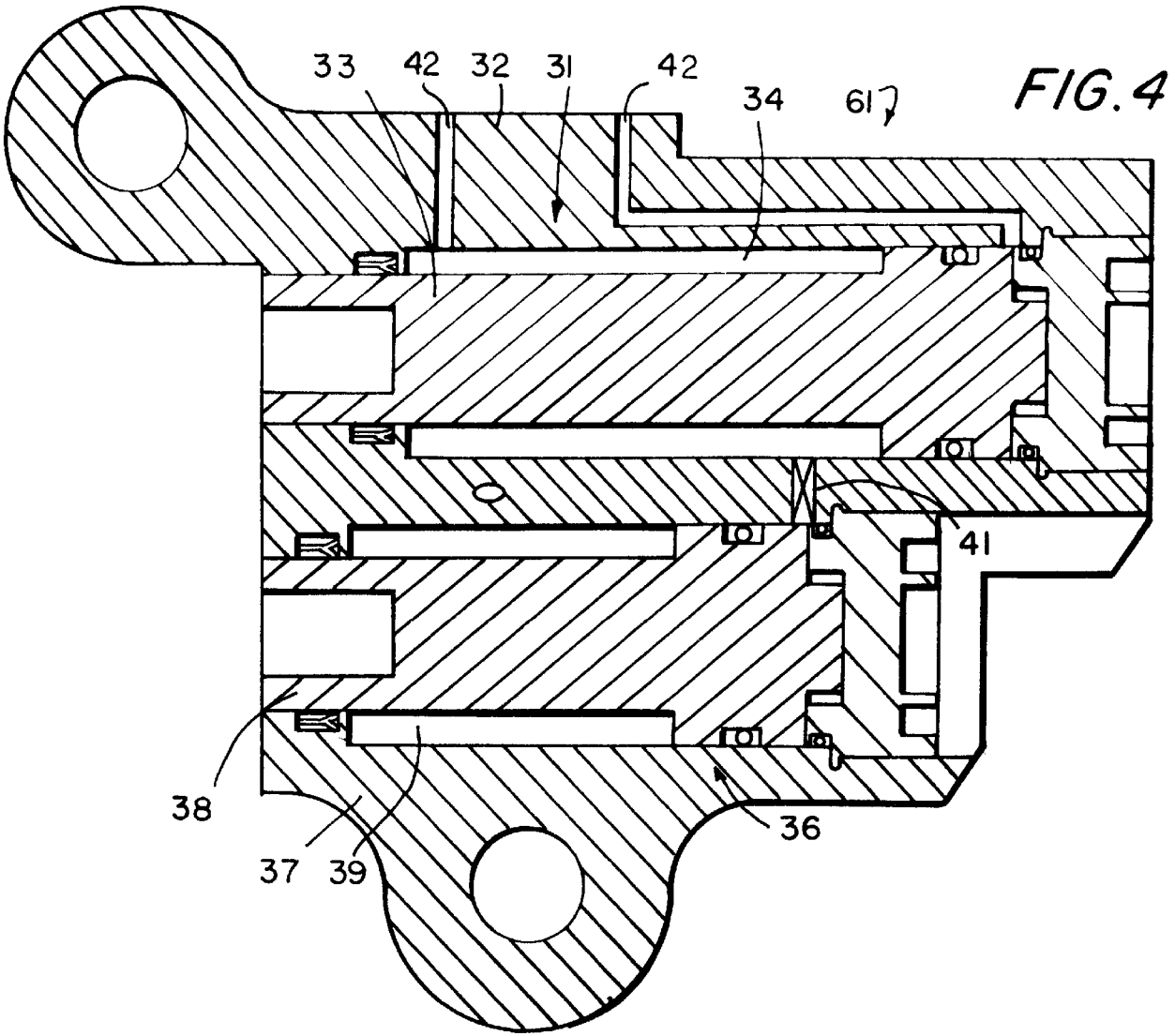
FIG. 4 is a view showing details of the fluid-operated tool of FIG. 3 on an enlarged scale.

The fluid operated tool in accordance with another embodiment of the present invention is shown in FIGS. 3 and 4. It has similar engaging means 1 including a ratchet 2 with an inner hexagonal opening 3 and a plurality of peripheral teeth 4. The driving means 6' is however formed somewhat differently. The driving means 6' has a first cylinder piston unit 31 which includes a cylinder 32 with a piston 33 reciprocating in a chamber 34 and having a piston rod which engages a pin 35 connecting the driving plates 40 with one another. The driving means 6' further has a cylinder-piston unit 36 with a cylinder 37 and a piston 38 reciprocatingly movable in a chamber 39. The piston 38 is also provided with a piston rod abutting against the driving plates 40. A valve 41 is arranged in a passage communicating the chamber 34 of the first cylinder-piston unit 31 with the chamber 39 of the second cylinder-piston unit 36. In a normal condition it is closed but it opens when a resistance exceeds a predetermined level.

The fluid operating tool of FIGS. 3 and 4 operates in the following manner. In an initial stage of tightening of a threaded connector the working fluid is supplied through the passages 42 into the chamber 34 of the first cylinder-piston unit 31, reciprocates the piston 33, and therefore turns the ratchet 2 and a threaded connector engaged by the ratchet with a low torque and a high speed. When the running down is finished and the tightening itself starts, a resistance of the threaded connector to the turning increases and a valve 41 provided between the cylinder-piston units 31, 36 opens so that the working fluid now flows also into the chamber 39 of the second cylinder-piston unit 36. The piston 38 of the second cylinder-piston unit 36 reciprocates and applies additional force to the driving plates, so that now the ratchet 2 is turned with a higher torque required for tightening of the threaded connector. It is to be understood that loosening of a threaded connector is performed in a reverse order.

In the tool in accordance with the present invention in addition to the benefits of having a faster operation during the initial stage of tightening and a greater torque during the final stage of tightening, there is an additional advantage. Since the fluid-operated driving elements 7, 8 and 31, 36 are located adjacent to one another in a plane perpendicular to the axis of the ratchet, the second housing portion 9 of the tool. This accommodates the fluid-operated driving means 7, 8; 31, 36 can be kept as thin as the first housing portion 42 which accommodates the engaging means 2, 3, 4, 5 of the tool which allows a better access of the tools in confined areas. It further eliminates that a wider housing portion rests on a surface lifting up the engaging point between the threaded connector (a nut) and the tool's connecting means grabbing nearly a portion of the threaded connector during operation.

It will be understood that each of the elements described above, or two or more together, may also find a useful application in other types of constructions differing from the types described above.

While the invention has been illustrated and described as embodied in fluid-operated tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fluid-operated tool for tightening and loosening of threaded connectors, comprising turnable engaging means for engaging a threaded connector so as to turn the threaded connector and to tighten and loosen the threaded connector; and driving means connected with said engaging means and acting on said engaging means so as to turn said engaging means, said driving means including two fluid-operated driving elements connected to said engaging means and operated so that during an initial stage of tightening or a final stage of loosening of a threaded connector one of said fluid-operated driving elements is actuated and drives said engaging means, while during a final stage of tightening or an initial stage of loosening of a threaded connector the other of said fluid-operated driving elements is operated.

2. A fluid-operated tool as defined in claim 1; and further comprising means for controlling said fluid-operated driving elements so that during said initial stage of tightening or said final stage of loosening of the threaded connector only said one fluid-operated driving element is actuated, while during said final stage of tightening or said initial stage of loosening of the threaded connector only the other of said fluid-operated driving elements is actuated.

3. A fluid-operated tool as defined in claim 1; and further comprising control means formed so that during said initial stage of tightening or said final stage of loosening of the threaded connector only said one fluid-operated driving element is actuated, while during said final stage of tightening or said initial stage of loosening of the threaded connector both said one fluid-operated driving element and said other fluid-operated driving element are actuated.

4. A fluid-operated tool as defined in claim 1, wherein said one fluid-operated driving element is a hydraulic motor, while said other fluid-operated driving element is a hydraulic cylinder-piston unit.

5. A fluid-operated tool as defined in claim 1, wherein said one fluid-operated driving element and said other fluid-operated driving element are formed as hydraulic cylinder-piston units.

6. A fluid-operated tool as defined in claim 1; and further comprising control means for actuating said fluid-operated driving elements, said control means being formed so that a working fluid is initially supplied into said one fluid-operated driving element and when a turning resistance of the threaded connector exceeds a predetermined value, the working fluid is supplied into said other fluid-operated driving element.

7. A fluid-operated tool as defined in claim 6, wherein said control means includes a valve which is provided between said fluid-operated driving elements and is normally closed and which opens when the turning resistance of the threaded connector exceeds the predetermined value.

8. A fluid-operated tool as defined in claim 1; and further comprising means for deactivating said one fluid-operated driving elements when a turning resistance of the threaded connector exceeds a predetermined value.

9. A fluid-operated tool as defined in claim 8, wherein said means for deactivating include an overrunning coupling which connects said one fluid-operated driving element with said engaging element and which disconnects said one fluid-operated driving element from said engaging element when the turning resistance of the threaded connector exceeds the predetermined value.

* * * * *